US006503182B2

(12) United States Patent
Toth

(10) Patent No.: US 6,503,182 B2
(45) Date of Patent: Jan. 7, 2003

(54) COMPACT APPARATUS AND SYSTEM FOR CREATING AND DISPENSING CUSHIONING DUNNAGE

(75) Inventor: Zsolt Toth, Tuckahoe, NY (US)

(73) Assignee: Zsolt Design Engineering, Inc., Tuckahoe, NY (US)

( * ) Notice: Subject to any disclaimer, the term of this patent is extended or adjusted under 35 U.S.C. 154(b) by 0 days.

(21) Appl. No.: 09/819,998

(22) Filed: Mar. 29, 2001

(65) Prior Publication Data

US 2002/0142905 A1 Oct. 3, 2002

(51) Int. Cl.[7] ..... B31B 27/14

(52) U.S. Cl. ..... 493/238; 493/233; 493/235; 493/967

(58) Field of Search ..... 493/967, 464, 493/233, 234, 235, 238; 53/390

(56) References Cited

U.S. PATENT DOCUMENTS

| | | | | | |
|---|---|---|---|---|---|
| 2,786,399 | A | * | 3/1957 | Mason et al. | 493/967 |
| 3,603,216 | A | * | 9/1971 | Johnson | 493/967 |
| 3,799,039 | A | * | 3/1974 | Johnson | 493/967 |
| 4,052,920 | A | * | 10/1977 | Dixon | 83/337 |
| 4,750,896 | A | * | 6/1988 | Komaransky et al. | 493/967 |
| 4,999,968 | A | * | 3/1991 | Davis | 493/238 |
| 5,076,555 | A | * | 12/1991 | Bunch, Jr. | 493/415 |
| 5,131,903 | A | * | 7/1992 | Levine et al. | 493/464 |
| 5,203,761 | A | * | 4/1993 | Reichental et al. | 493/967 |
| 5,643,647 | A | | 7/1997 | Wischusen, III | |
| 5,730,696 | A | * | 3/1998 | Simmons | 493/967 |
| 5,749,539 | A | | 5/1998 | Ratzel et al. | |
| 5,755,656 | A | * | 5/1998 | Beierlorzer | 493/967 |
| 5,785,639 | A | | 7/1998 | Simmons | |
| 5,902,223 | A | * | 5/1999 | Simmons | 493/967 |
| 5,938,580 | A | | 8/1999 | Siekmann | |
| 6,033,353 | A | * | 3/2000 | Lencoski et al. | 493/464 |
| 6,146,321 | A | * | 11/2000 | Simmons | 493/967 |
| 6,179,765 | B1 | | 1/2001 | Toth | |
| 6,200,251 | B1 | * | 3/2001 | Harding et al. | 493/464 |
| 6,217,501 | B1 | * | 4/2001 | Simmons et al. | 493/967 |
| 6,240,705 | B1 | * | 6/2001 | Simmons et al. | 493/967 |
| 6,277,459 | B1 | * | 8/2001 | Lencoski et al. | 493/967 |

OTHER PUBLICATIONS

International Search Report in PCT/US02/06553, mailed May 21, 2002.

* cited by examiner

*Primary Examiner*—John Sipos
*Assistant Examiner*—Louis Huynh
(74) *Attorney, Agent, or Firm*—Antonelli, Terry, Stout, & Kraus, LLP

(57) ABSTRACT

A system for creating and dispensing cushioning dunnage is small and permits flexible installation configuration options for a single or for multiple packing stations. A compact apparatus of the system is capable of being pivotally mounted as a unit on a stand and includes a motor and a material feeding arrangement driven by the motor for pulling material from a supply roll of the material supported on a stand of the system, and feeding it through the apparatus. A plurality of material shaping members upstream of the feeding arrangement shape the material in the apparatus to convert it into a continuous strip of cushioning product. A perforator driven by the motor perforates the material at spaced locations along the length of the material to allow an operator to manually rip a desired length of cushioning product from the material being dispensed from the apparatus.

22 Claims, 15 Drawing Sheets

COMPACT APPARATUS AND SYSTEM FOR CREATING AND DISPENSING CUSHIONING DUNNAGE

RELATED APPLICATION

Commonly owned U.S. patent application Ser. No. 09/819,640, filed concurrently herewith, for Automatic Roll Tensioner and Material Dispensing System Using the Same, is hereby incorporated by reference.

TECHNICAL FIELD

The invention relates to an apparatus and a system employing the same for creating and dispensing material for use as void fill and cushioning dunnage in the packaging industry when shipping products in boxes, for example.

BACKGROUND

Cushioning dunnage is used as a protective packaging material when shipping an item in a container. The dunnage fills any voids and/or cushions the item in the container during shipping. Typical materials for forming cushioning dunnage include paper and plastic. Relatively complicated machines and methods are known for producing cushioning dunnage comprising resilient pillow-like strips from rolls of stock material. One such known machine is disclosed in U.S. Pat. No. 5,785,639. The known machines are disadvantageous in that they are suitable primarily for larger-scale productions and they are relatively expensive. There has long been a need in the packaging industry for a small and inexpensive device that creates and dispenses paper or other material for use as void fill and cushioning when shipping products in boxes or other containers.

SUMMARY

The present invention addresses this need in providing a compact apparatus and a system employing the apparatus for creating and dispensing cushioning dunnage. The apparatus and system are capable of meeting the needs of both ends of the customer spectrum. Namely, the compact apparatus and system of the invention are affordable and practical for a customer whose packing needs can be met with a single unit that does not take up a lot of space. The apparatus and system can also serve the needs of customers with high-speed and high-volume production lines having multiple, stand alone packing stations and/or centralized packing stations.

A compact apparatus according to the invention for creating and dispensing material for use as void fill and cushioning dunnage is small enough that it is capable of being mounted as a unit on a stand. The compact apparatus or head comprises a motor and a material feeding arrangement driven by the motor for pulling material from a supply of material and feeding it through the apparatus where it is converted into a cushioning product. A plurality of material shaping members upstream of the material feeding arrangement in the compact apparatus shape the material to convert it into a continuous strip of cushioning product as the material is fed through the apparatus. A perforator driven by the motor perforates the material at spaced locations along the length of the material as the material is fed through the apparatus to allow an operator to rip from the apparatus a desired length of cushioning product being dispensed by the apparatus.

A system of the invention for creating and dispensing material for use as void fill and cushioning dunnage includes the aforementioned compact apparatus and a stand on which the compact apparatus is mounted. According to an example embodiment, the compact apparatus is pivotally mounted on the stand to facilitate material loading. In one form of the invention, the stand is a material cart with wheels, the material cart including a support for rotatably supporting a roll of material which is to be pulled from the roll and supplied to the compact apparatus. An automatic roll tensioner for tensioning material being pulled from the roll maintains tension on the material even when pulling suddenly stops. The cart can also include a work surface for an operator handling cushioning product dispensed by the compact apparatus. As a further feature of the invention, an overhead delivery system is provided for delivering rolls of material to the roll support of a system where the roll support is elevated above an adjacent work surface for an operator handling cushioning product dispensed by the compact apparatus.

These and other features and advantages of the present invention will become more apparent from the following description when taken in connection with the accompanying drawings which show, for purposes of illustration only, several example embodiments in accordance with the present invention.

BRIEF DESCRIPTION OF DRAWINGS

The following represents brief descriptions of the drawings, wherein.

DETAILED DESCRIPTION

Figure 1:
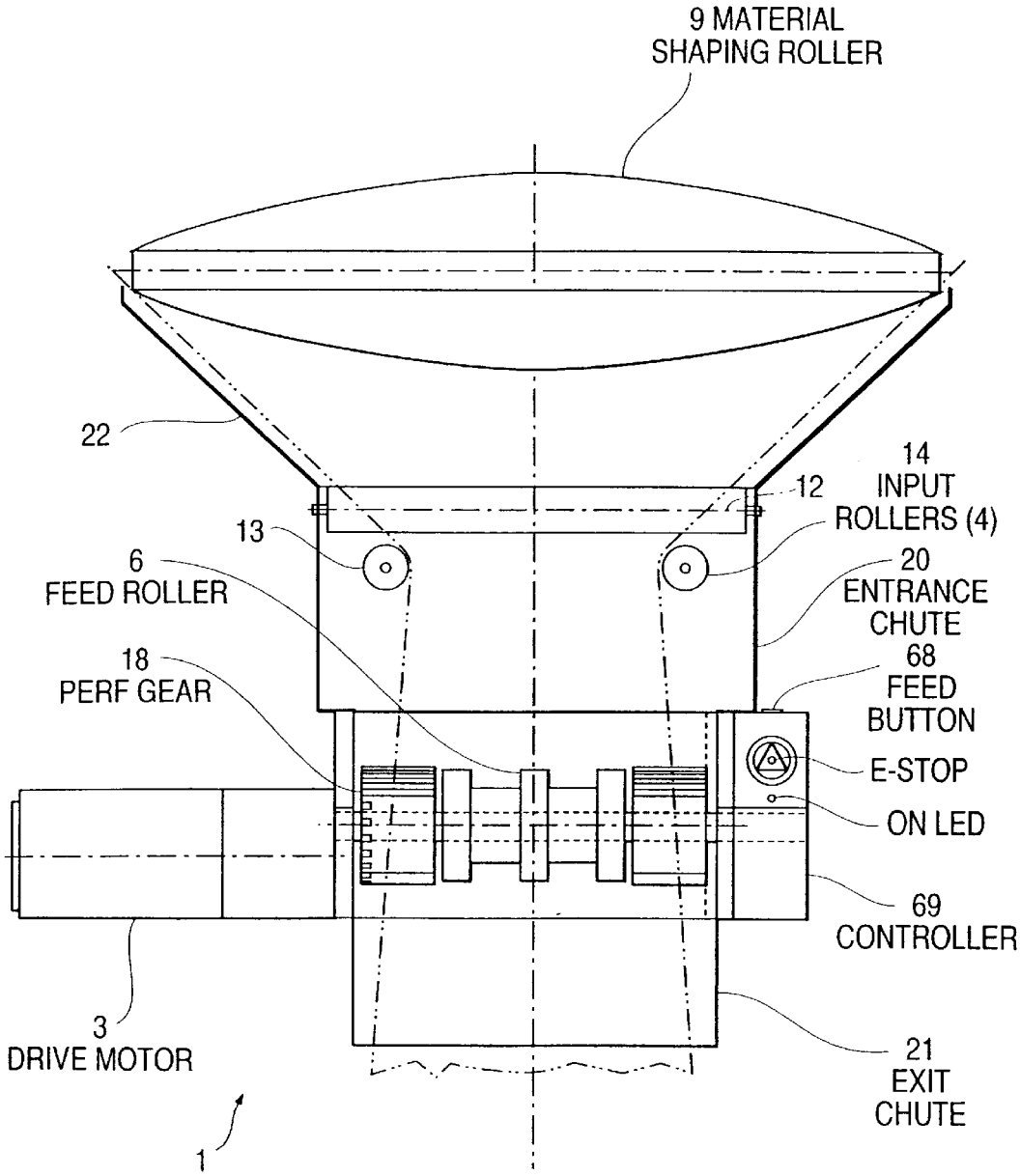
FIG. 1 is a front side view of a compact apparatus according to an example embodiment of the invention for creating and dispensing material for use as void fill and cushioning dunnage.
Figure 2:
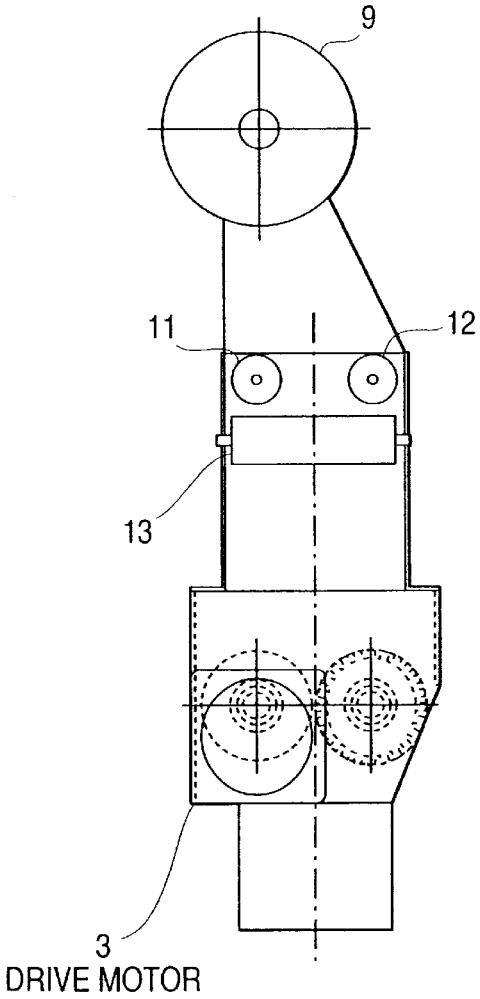
FIG. 2 is a left side view of the compact apparatus of FIG. 1.
Figure 3:
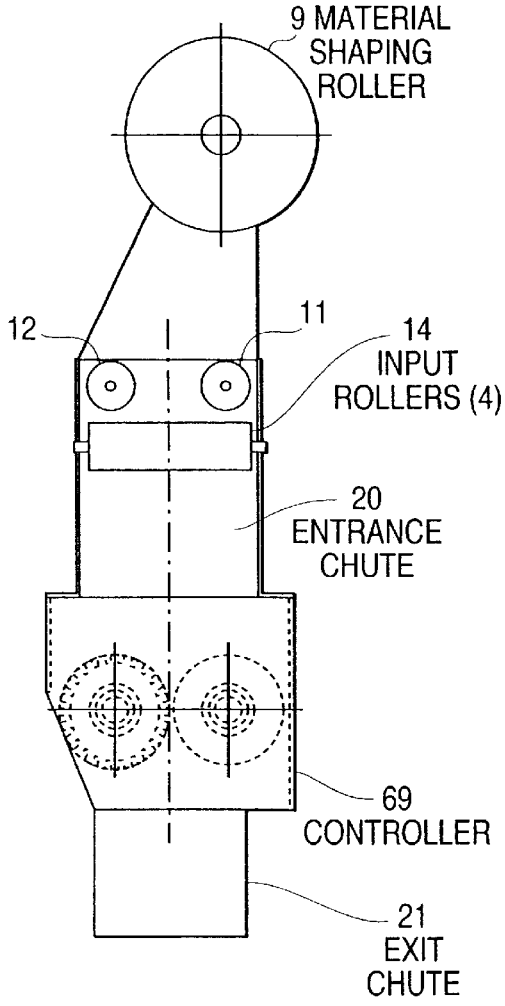
FIG. 3 is a right side view of the compact apparatus of FIG. 1.

Referring now to the drawings, a compact apparatus 1 of the invention, as shown in FIGS. 1–6, is for creating and dispensing material for use as a void fill and cushioning dunnage. The apparatus 1 is a relatively small, integral unit capable of being mounted on a stand, for example, floor stand 2 in FIG. 6. The apparatus 1 comprises a motor 3 and a material feeding arrangement 4, FIG. 4, driven by the motor for pulling material from a supply of material, e.g., a material roll 5 in FIG. 6, and feeding it through the apparatus.

Figure 4:
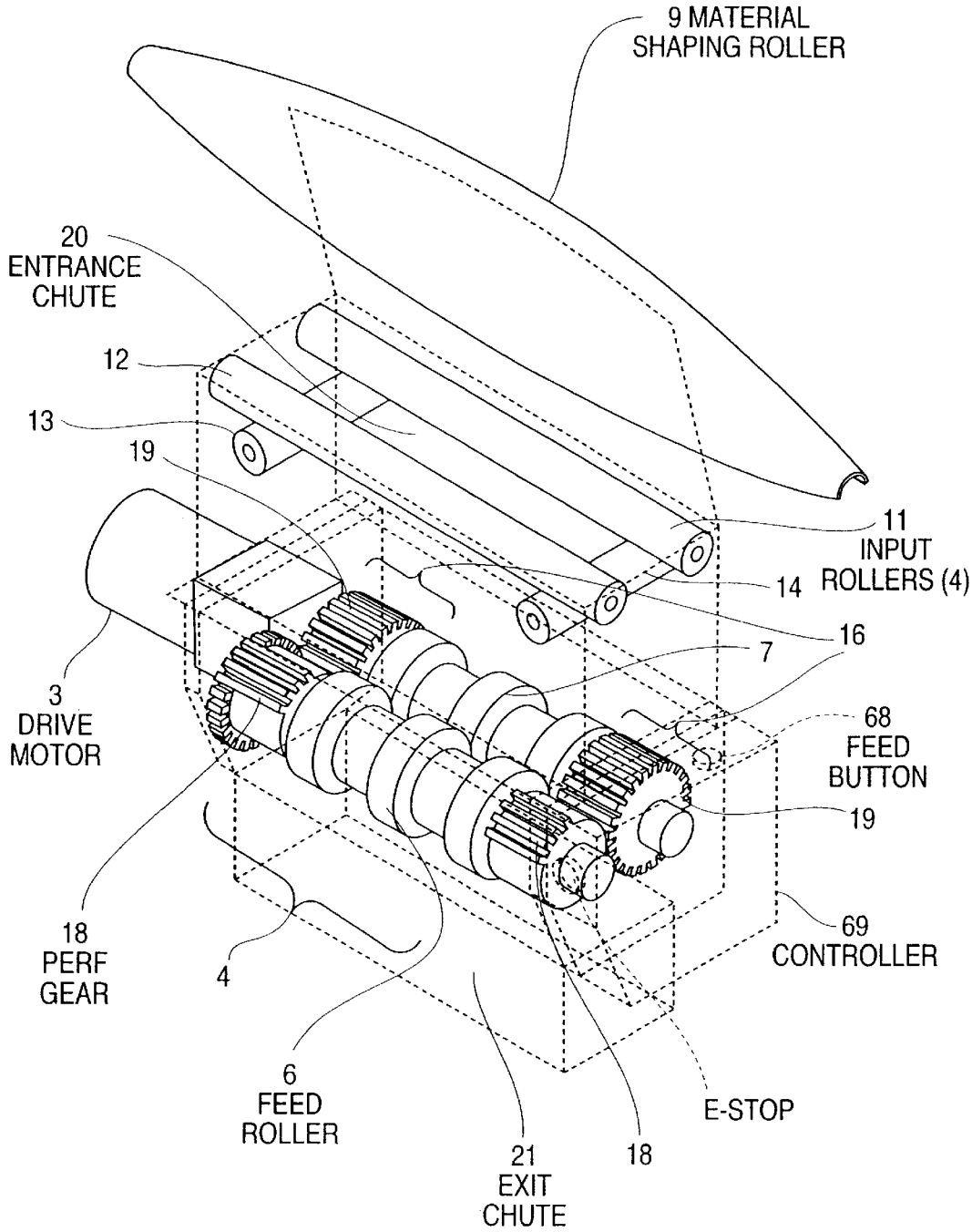
FIG. 4 is a schematic drawing of functional components of the compact apparatus of FIGS. 1–3 more clearly showing the components.
Figure 5:
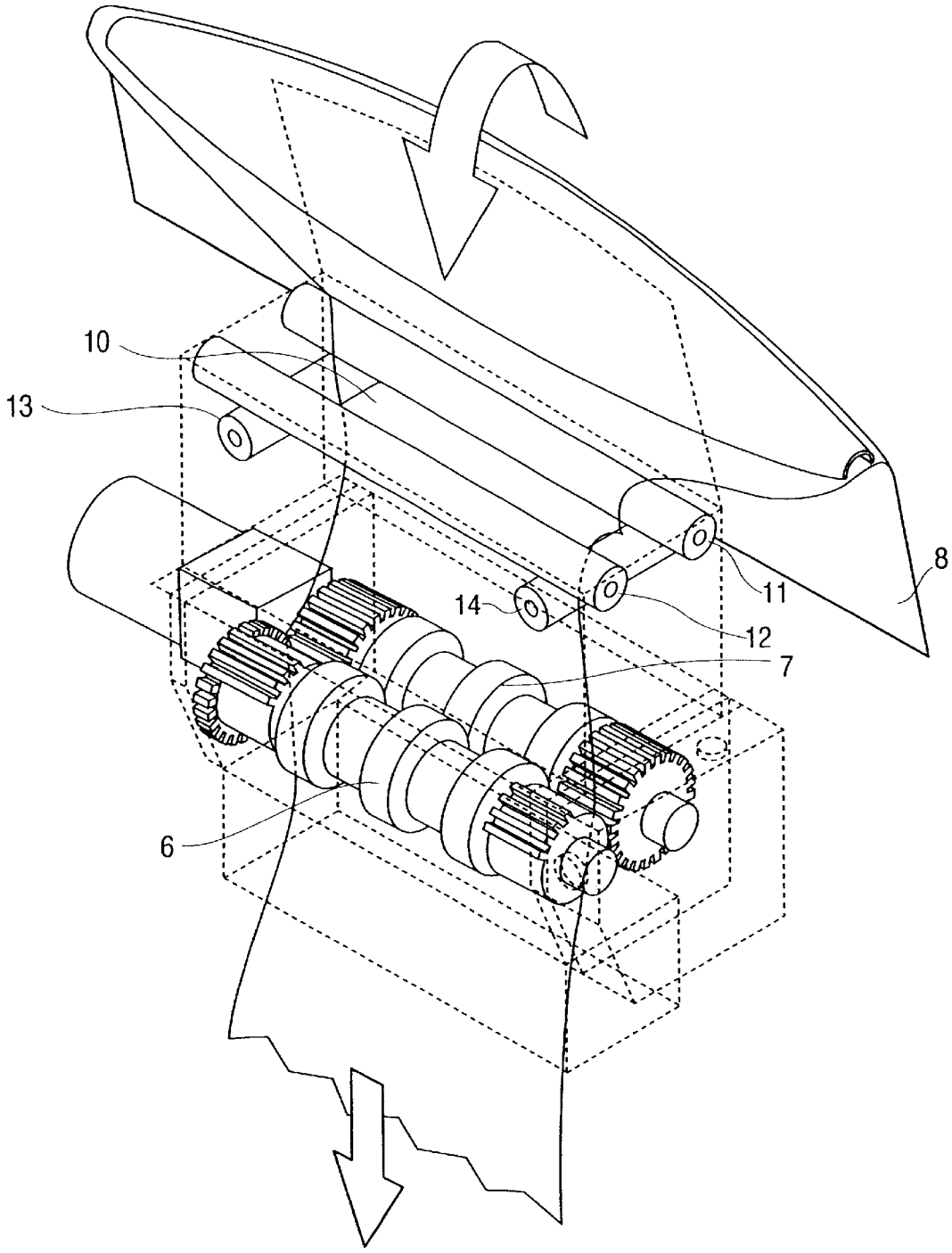
FIG. 5 is a schematic drawing like FIG. 4 showing the apparatus functional components in relation to a paper material being pulled into the apparatus from a supply roll of the paper and fed through the apparatus while being converted into a cushioning product.
Figure 7A:
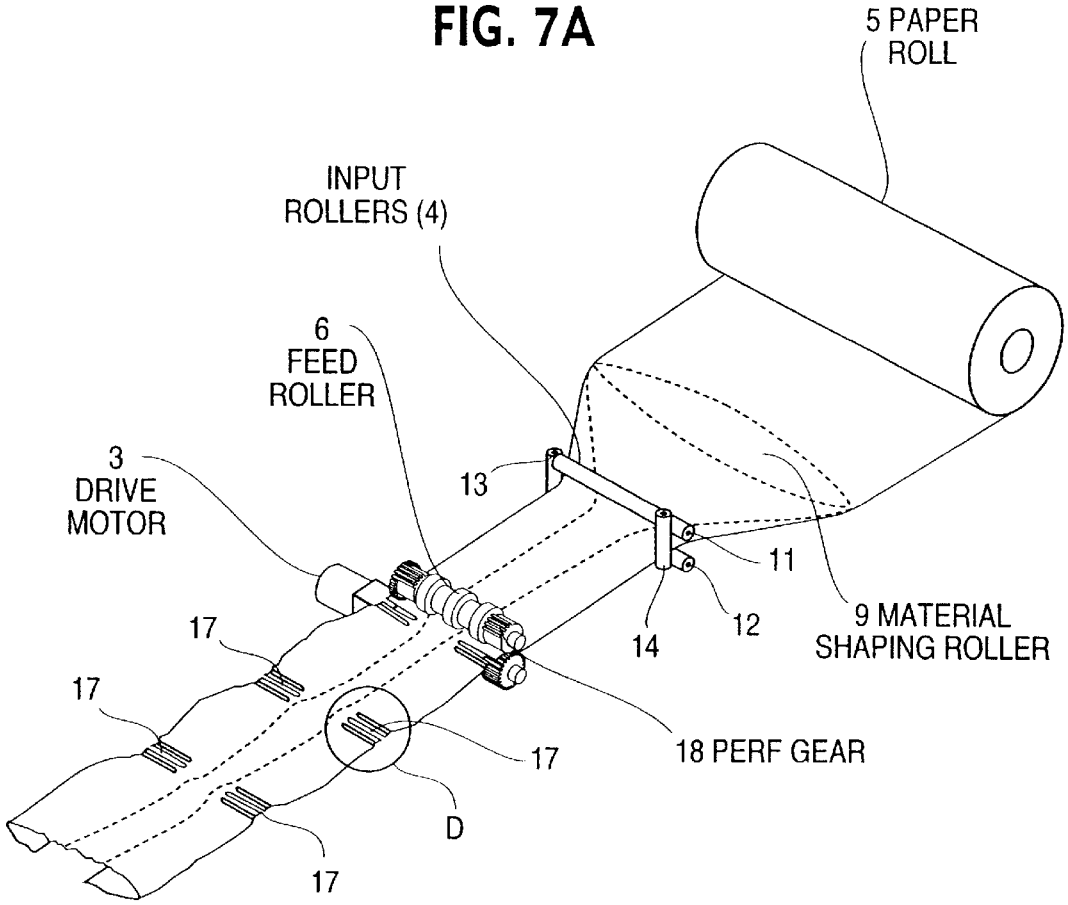
FIG. 7A is a view similar to FIG. 5 but showing more details of the pillow-like product formed by the apparatus with spaced perforations along the length of the product enabling an operator to tear off in a predictable way a desired length of the material from the continuous strip dispensed from the apparatus.
Figure 7B:
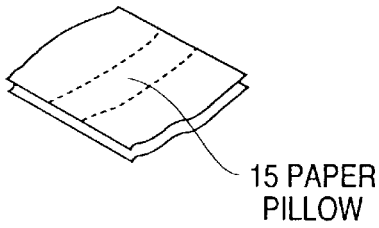
FIG. 7B is a perspective view from above and to one side of a paper pillow which has been ripped from the free end of the continuous cushioning product shown in FIG. 7A.
Figure 7C:
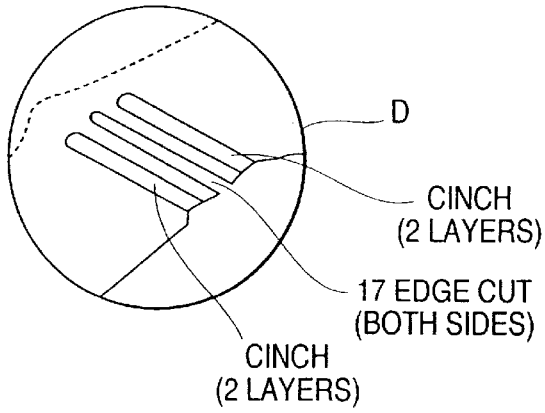
FIG. 7C is an enlarged view of the portion of the cushioning product within the circle D in FIG. 7A, illustrating a perforated area along one edge of the cushioning product.

The material feeding arrangement 4 comprises cooperating feed rollers 6 and 7, see FIG. 4, between which the material 8, paper in the example embodiment, is fed as depicted in FIG. 5. A plurality of material shaping members upstream of the material feeding arrangement 4 shape the material 8 into a continuous strip of cushioning product as the material is fed through the apparatus 1. The material shaping members include a convex material shaping roller 9 over which the material 8 is drawn by the feed rollers 6 and 7. An input opening 10 for the material 8 downstream of the convex roller 9 is defined by first and second pairs of spaced, parallel rollers 11, 12 and 13, 14. The second pair of rollers 13, 14 extend in a direction transverse to that of the first pair of rollers 11, 12. When the material 8 is drawn over the convex roller 9, the lateral edges of the material are directed in a first direction over the convex surface of the roller 9. Continued movement of the material 9 through the input opening 10 directs the lateral edges of the material 8 in a second direction such that the edges are folded back on the material for forming a continuous strip of cushioning product. More particularly, as shown in FIGS. 7A, 7B and 7C, the convex roller 9 and two pairs of rollers 11, 12 and 13, 14 constitute a conversion assembly through which the paper from the roll 5 is pulled by the feed rollers 6 and 7 to fold and form the paper into pillow-like shapes for use as cushioning dunnage, see paper pillow 15 in FIG. 7B.

The compact apparatus 1 further comprises a perforator 16 driven by the motor 3 for perforating paper material 8 at spaced locations 17 along the length of the material as the material is fed through the apparatus. The line perforations 17 on each side of the material are edge cuts made by cooperating perforation gears 18 and 19 between which the material is fed. The perforation gears 18 and 19 are arranged coaxial with the feed rollers 6 and 7 on each side of the material being fed. When the pillow-like shaped material is dispensed from the compact apparatus 1, an operator can rip from the apparatus a desired length of cushioning product, such as pillow 15 in FIG. 7B, because of the spaced perforations 17 in the material.

An input chute 20 and an output chute 21 of the apparatus 1 guide the material 8 on respective sides of the material feeding arrangement 4. The input and output chutes, convex material shaping roller 9, input rollers 11, 12 and 13, 14 and other components of the apparatus are mounted as a unit on the supporting frame 22 of the apparatus. In the example embodiment, the compact apparatus 1 is mounted on the floor stand 2, FIG. 6, for multi-directional pivoting for ease of loading paper material. Different positions for the pivotal head 1 on the floor stand 2 are shown in dashed lines in FIG. 6. It is noted that the size of the input opening 10 delimited by the roller pairs 11, 12 and 13, 14 is small enough to preclude an operator's hand from being inserted through the input opening for operator safety.

Figure 6:
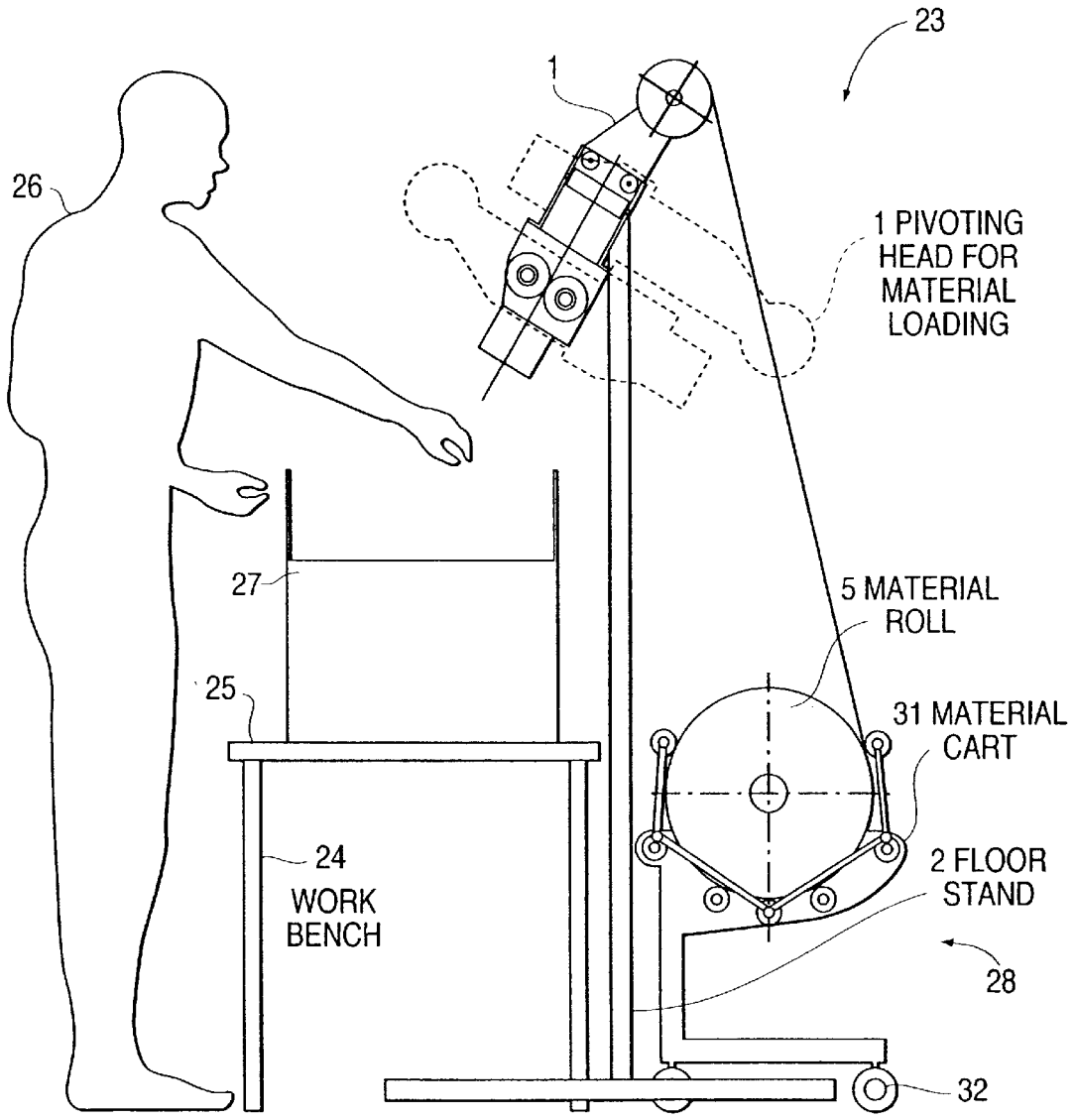
FIG. 6 is a right side view of a first example embodiment of a system of the invention which includes the compact apparatus of FIGS. 1–5 mounted on a floor stand located behind a work bench with a material cart with automatic roll tensioner supporting a material roll supplying paper to the apparatus.

A system 23 of the invention for creating and dispensing material for use as void fill and cushioning dunnage is shown in FIG. 6. The system includes, in combination, the compact apparatus 1 and a stand 2 on which the compact apparatus is mounted. The system 23 further comprises a work bench 24 providing a work surface 25 for an operator 26 for moving pillow-like shaped material 15 from the apparatus 1 and inserting it into the box 27 containing an item to be shipped. The system 23 of FIG. 6 further comprises a roll support 28 which rotatably supports the paper roll 5 from which the material can be unwound by being pulled by the feed rollers 6 and 7 of the compact apparatus 1 for supply to the compact apparatus. The roll support 28 in the system 23 in FIG. 6 is in the form of a material cart 31 with wheels 32.

Figure 8:
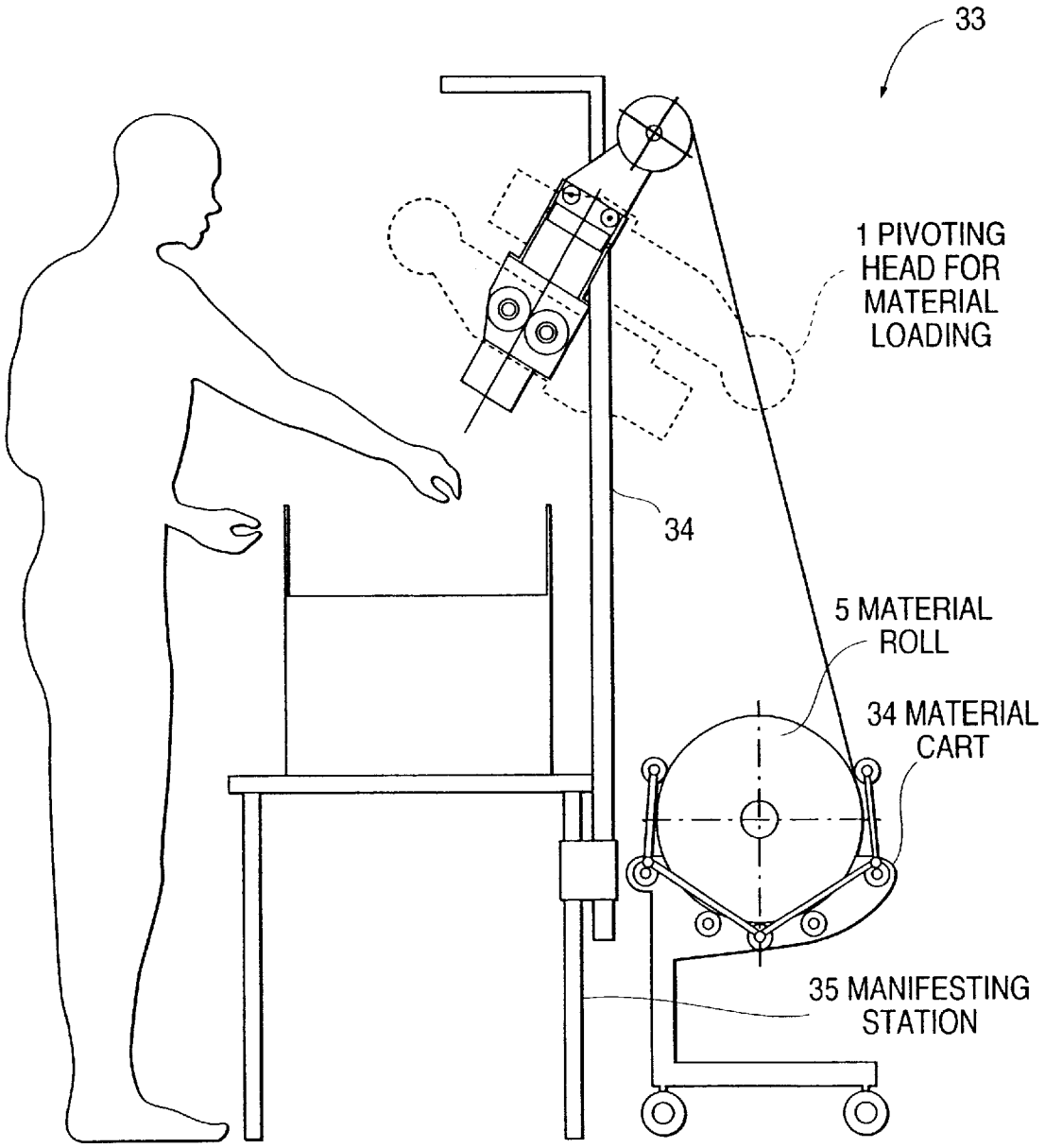
FIG. 8 is a right side view of a second example embodiment of a system according to the invention wherein the compact apparatus is mounted on a manifesting station above a work surface thereof.
Figure 9:
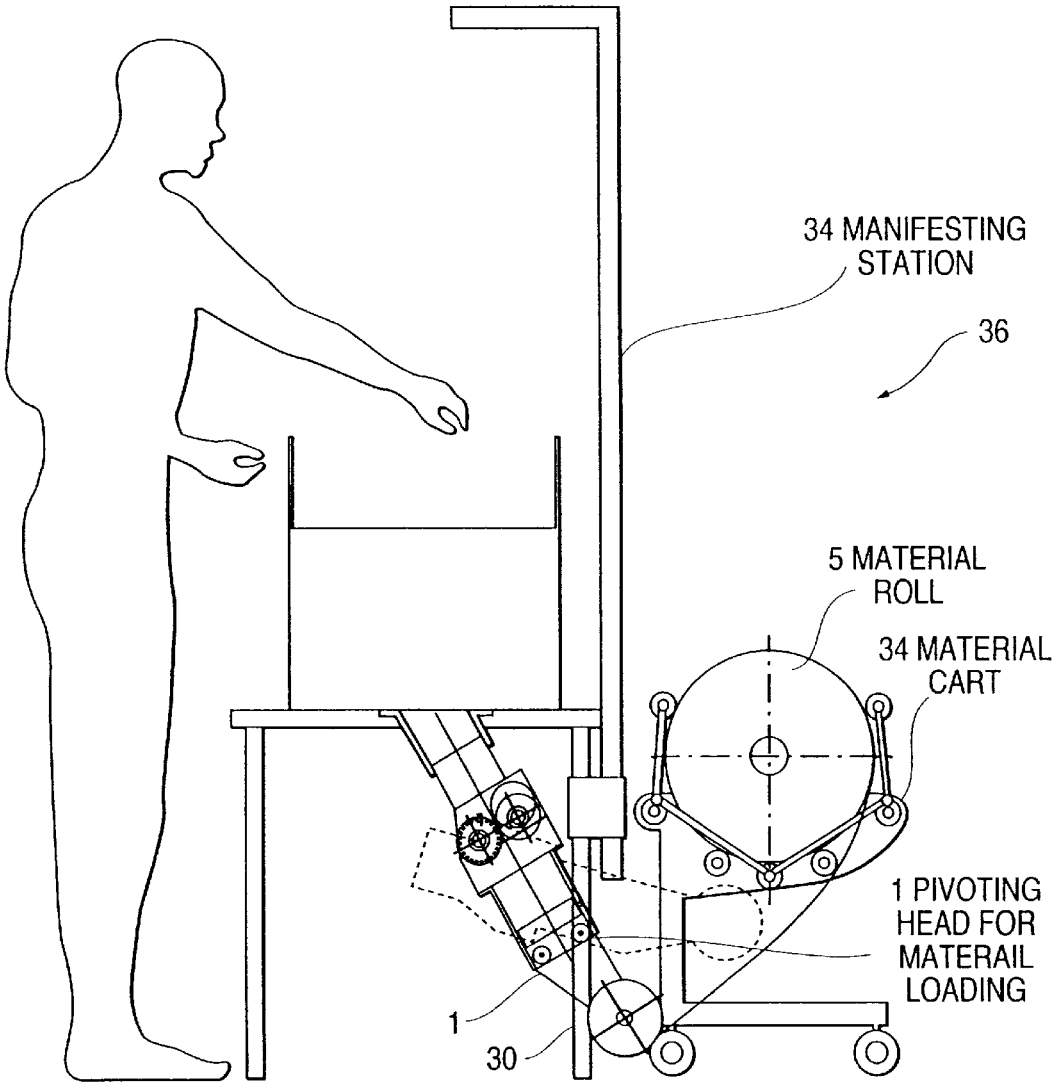
FIG. 9 is a right side view of a third example embodiment of the system of the invention wherein the compact apparatus of the invention is pivotally mounted on a material cart and positioned beneath a work surface of a manifesting station.
Figure 10:
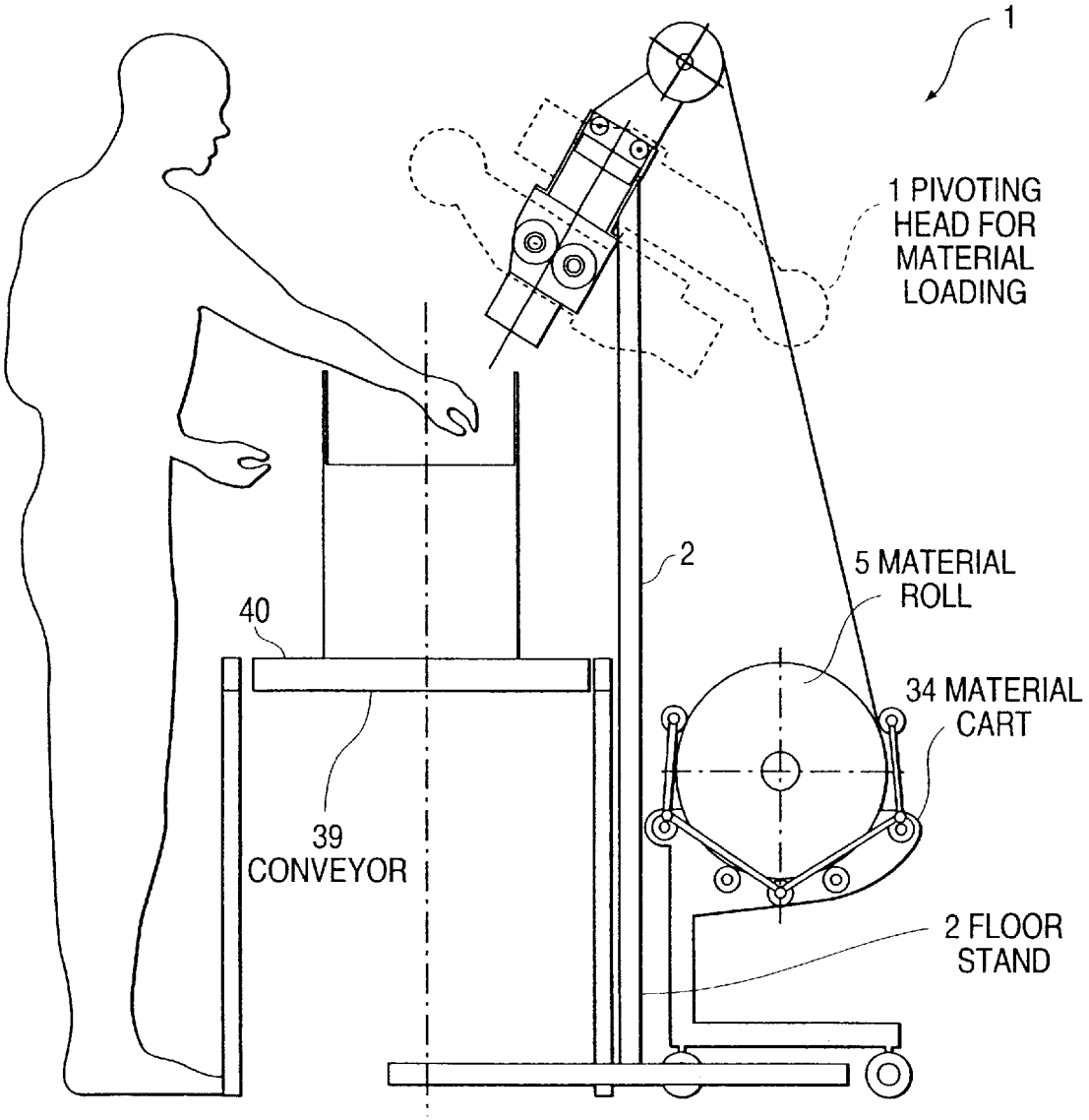
FIG. 10 is a right side view of a fourth example embodiment of the system of the invention having a conveyor providing a work surface in front of a floor stand carrying the compact apparatus of the invention.
Figure 11:
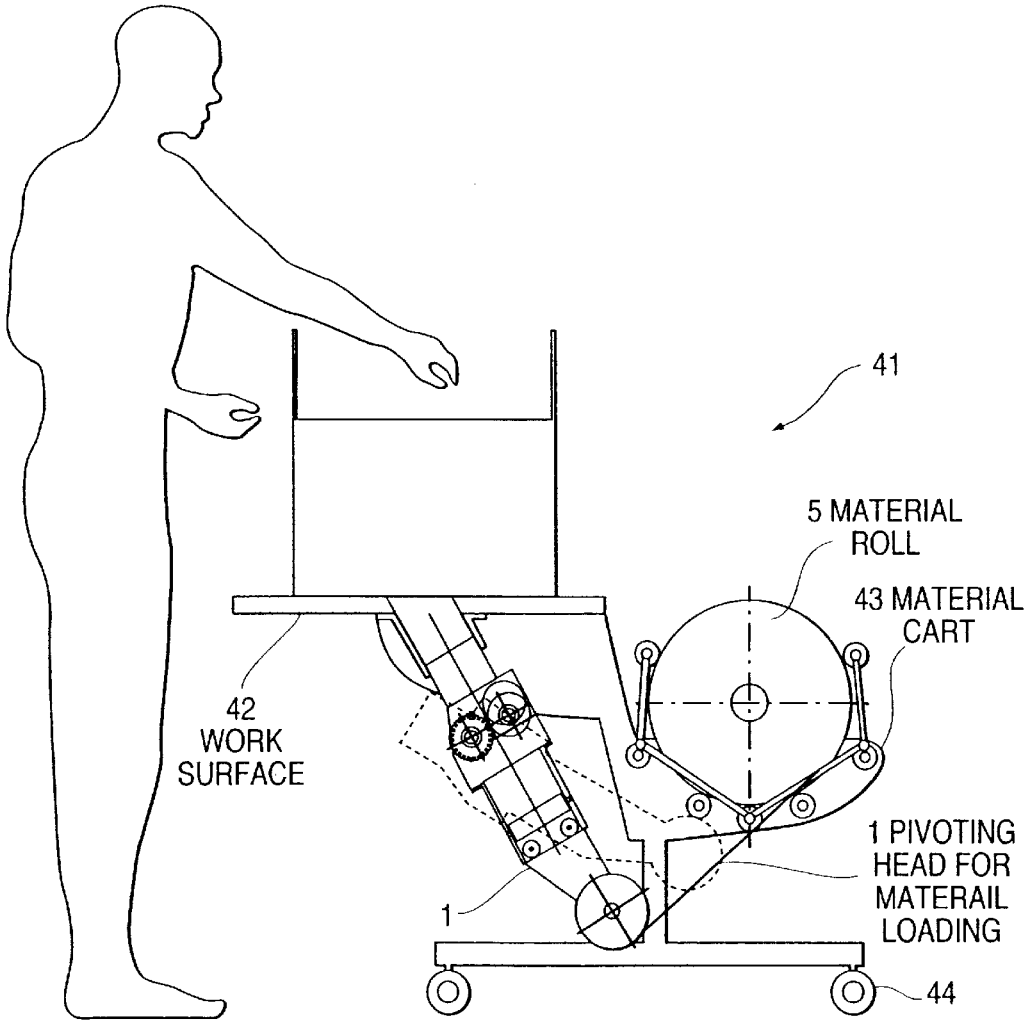
FIG. 11 is a right side view of a fifth example embodiment wherein a material cart of the system includes a work surface and has the compact apparatus pivotally mounted to the cart.

The system 33 in the example embodiment of FIG. 8 comprises a stand 34 supported on a manifesting station 35. The system 36 in FIG. 9 is similar to that in FIG. 8, except that the compact apparatus 1 is pivotally mounted beneath the work surface of the manifesting station on a lower leg 30 of the manifesting station. The system 38 in the example embodiment of FIG. 10 employs a floor stand 2 like that in FIG. 6 with a conveyor 39 being located in front of the compact apparatus to provide a work surface 40. The system 41 of FIG. 11 integrates the work surface 42 with material cart 43. The cart 43 also serves to pivotally mounted the compact apparatus 1 beneath the work surface 42. The entire system is portable because of the wheels 44 on the cart 43.

Figure 12:
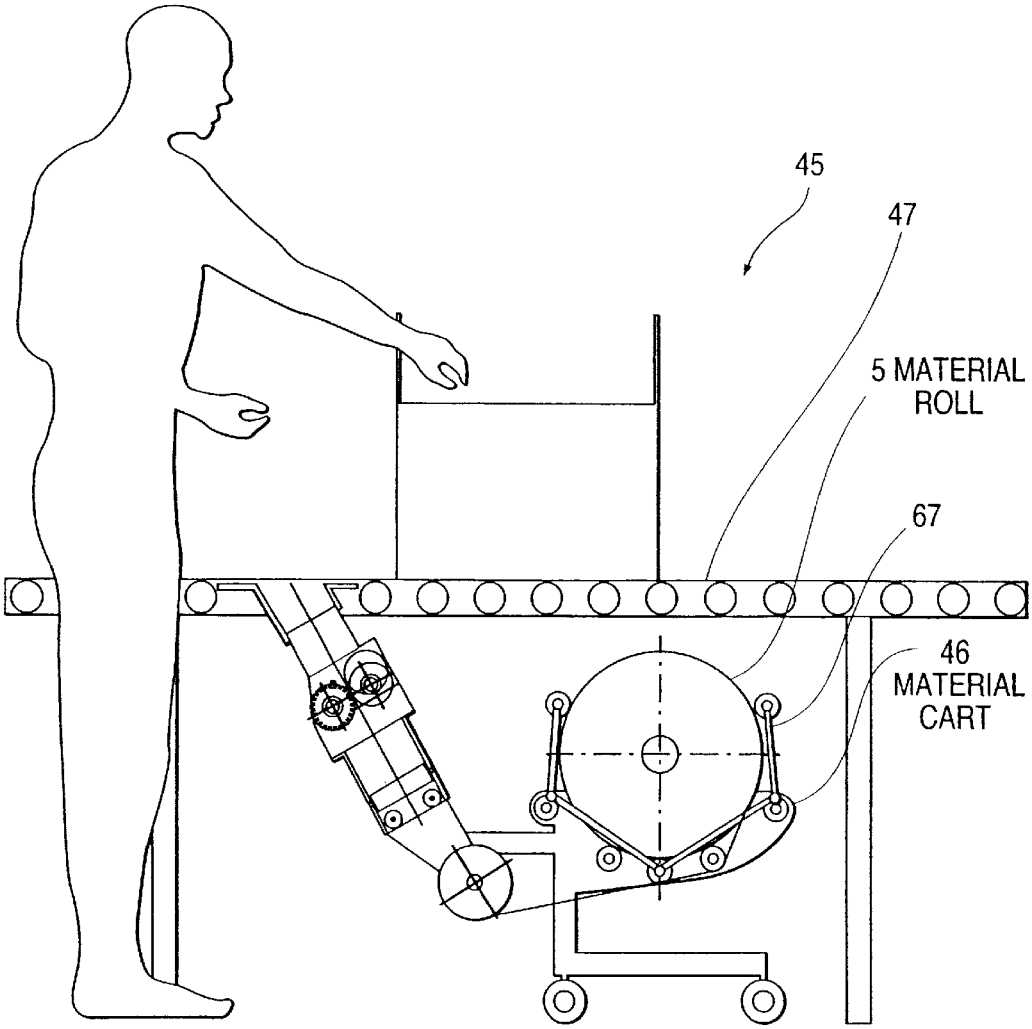
FIG. 12 is a right side view showing a sixth example embodiment wherein the entire material cart with compact apparatus mounted thereon is located beneath a conveyor of the system.
Figure 13:
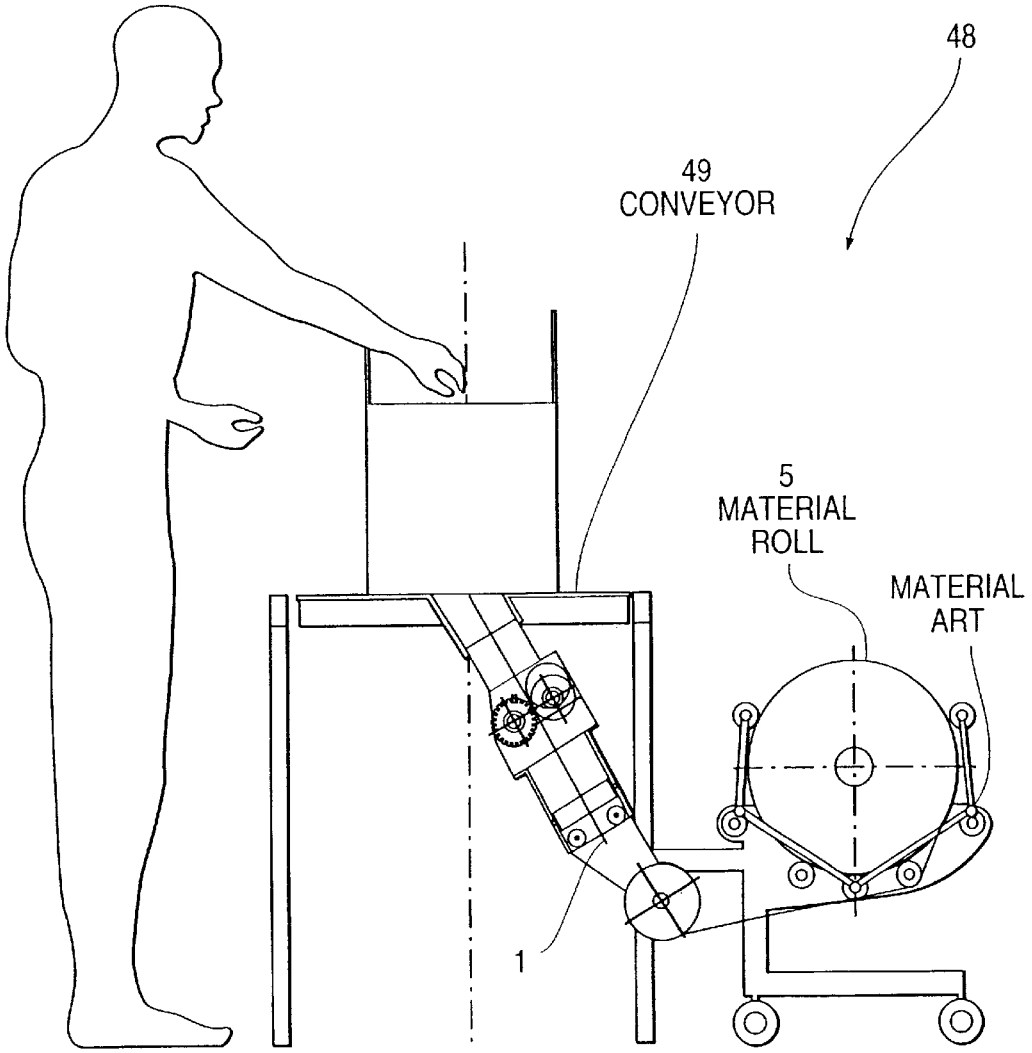
FIG. 13 is a right side view of another example embodiment of the system wherein the material cart is located behind a conveyor and supports the compact apparatus in a position beneath the conveyor.

A system 45 in the example embodiment of FIG. 12 employs a material cart 46 with roll tensioner 67 that pivotally supports the compact apparatus 1 beneath a conveyor 47. The system 48 of FIG. 13 is similar to that in FIG. 12, except that the material cart is located behind the conveyor 49 with only the compact apparatus 1 located beneath the conveyor.

Figure 14:
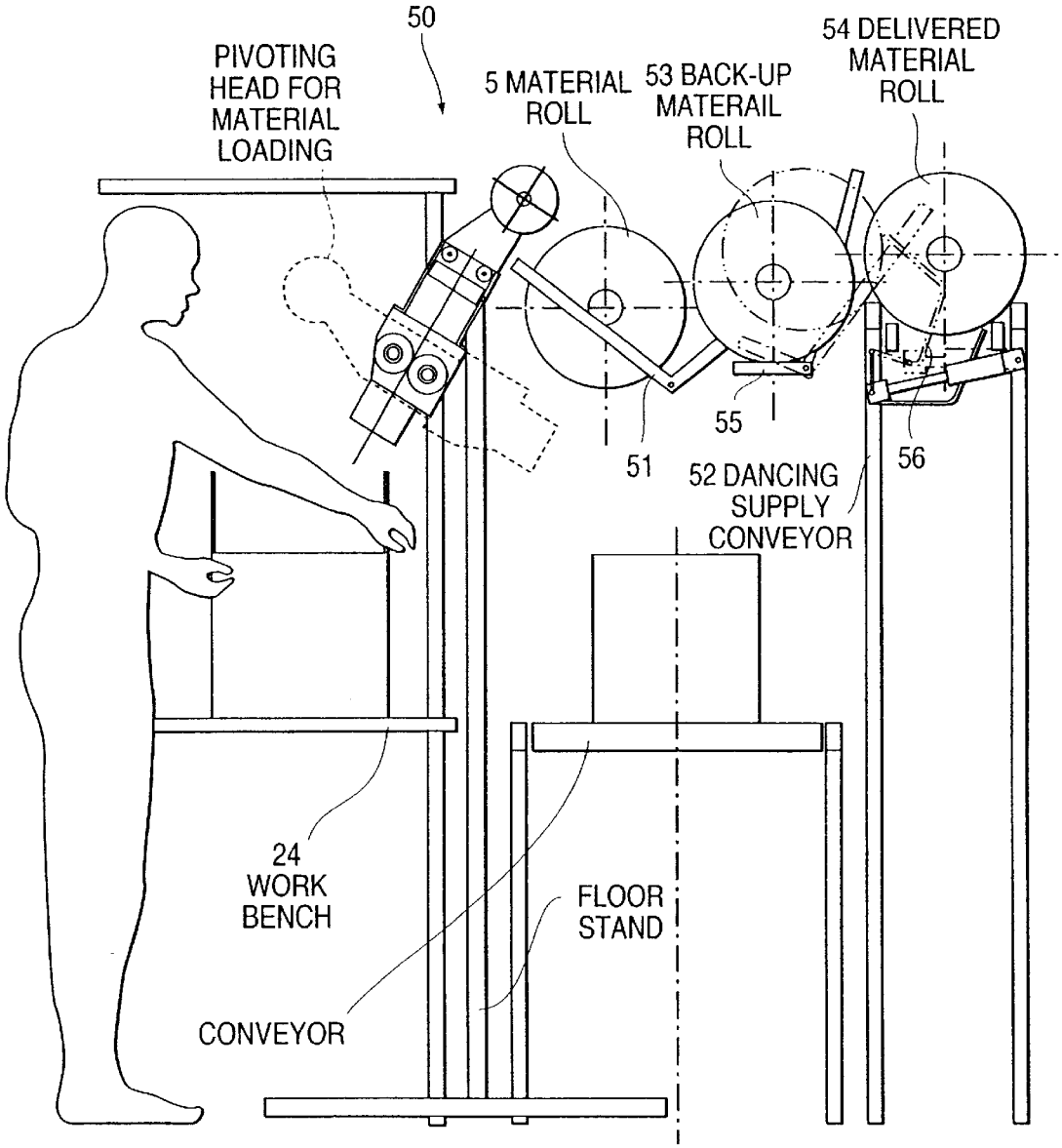
FIG. 14 is a right side view of a further example embodiment of the system depicting an elevated roll delivery arrangement thereof for supplying rolls of material to be used for creating a cushioning product with the system.
Figure 15:
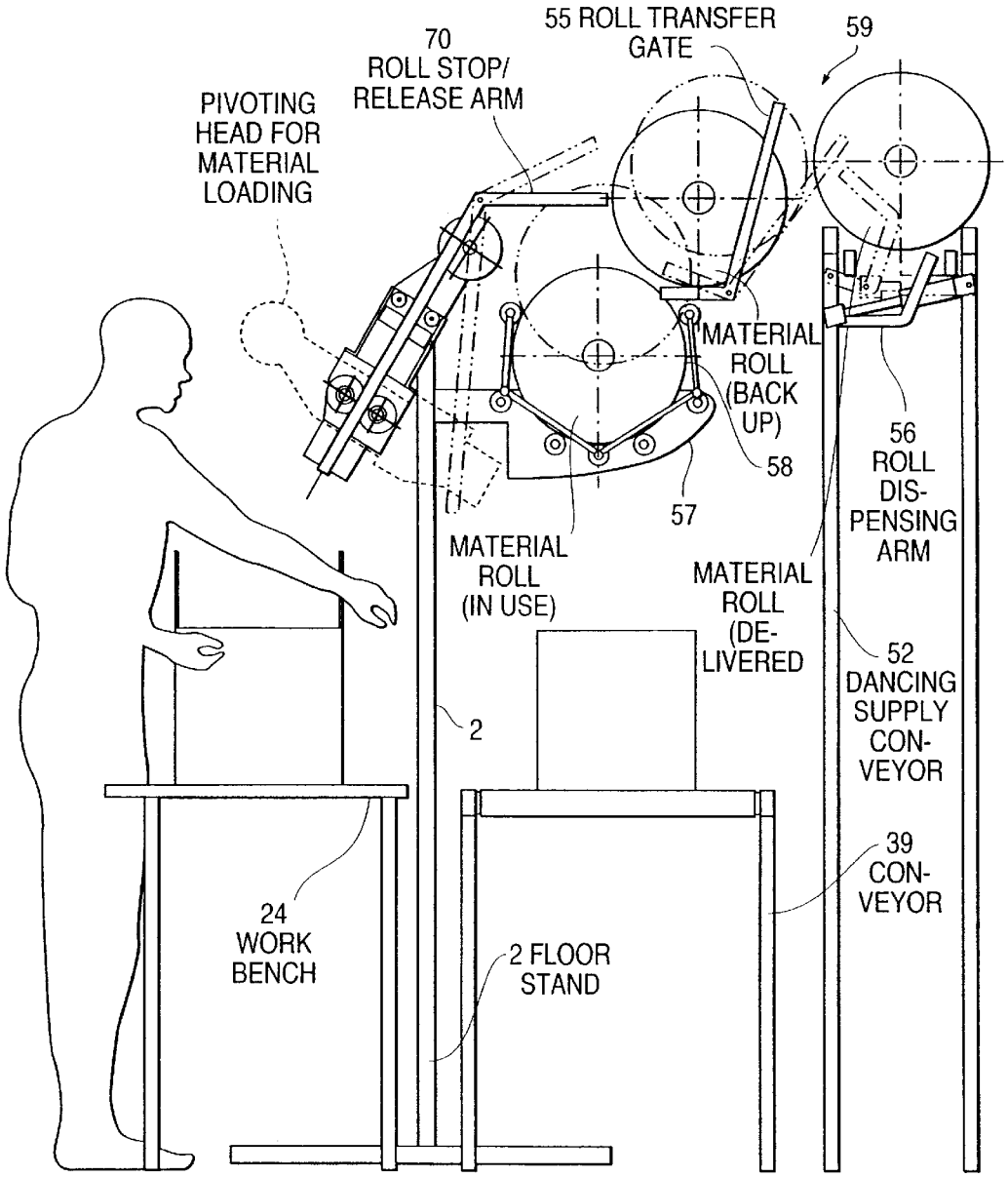
FIG. 15 is a variation of the system according to FIG. 14 schematically showing the use of a roll tensioner as part of the roll support.

A system 50 in FIG. 14 includes an elevated roll support 51 for the material roll 5 with a dancing supply conveyor 52 supplying a back-up material roll 53 for delivery to the roll support 51 to replenish the paper supply as needed. The dancing supply conveyor 52 presents a delivered material roll 54 as depicted in FIG. 14. The delivered material roll 54 is transferred to the position of the back-up material roll 53 by the pivotal transfer arms 55 and 56 shown schematically in FIG. 14. A variation of the system of FIG. 14 is shown in FIG. 15, wherein roll support 57 includes pretensioner 58. The roll support is mounted on the floor stand 2 and the dancing supply conveyor 52 in the system 59 of FIG. 15.

Figure 16A:
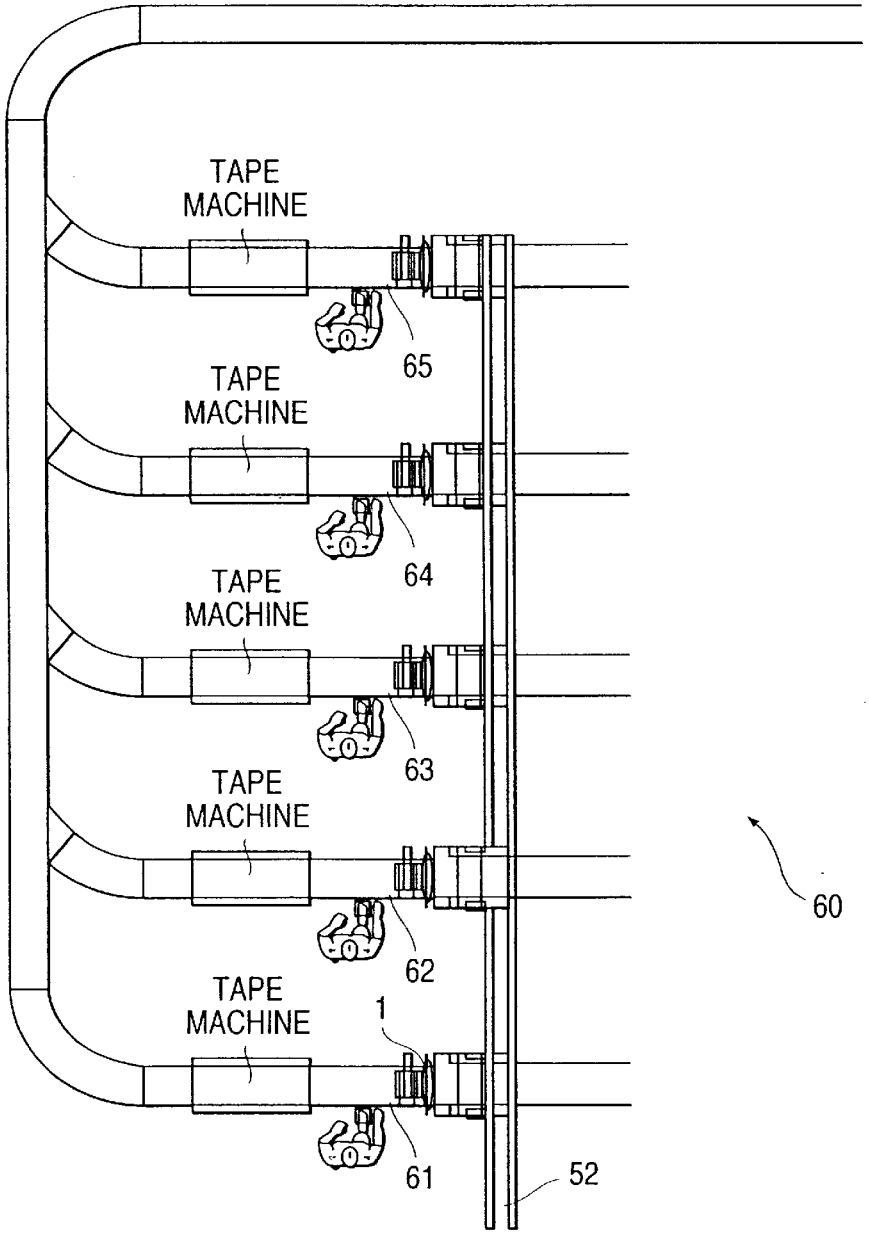
FIG. 16A is a top view of an additional system of the invention wherein an overhead roll delivery arrangement supplies material rolls to a plurality of individual work stations, each having a compact apparatus of the invention.
Figure 16B:
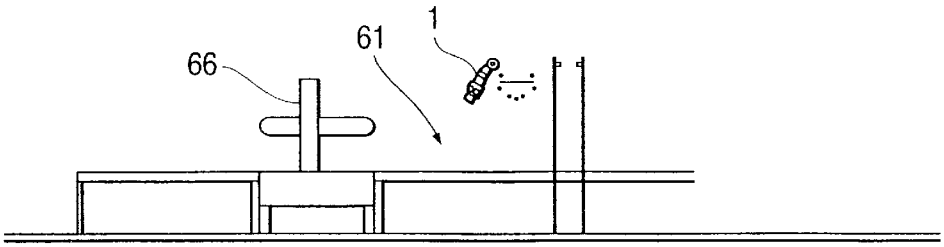
FIG. 16B is a front side view of one work station of the system of FIG. 16A.

The overhead dancing supply conveyor 52 is schematically shown in the system 60 of FIGS. 16A and 16B, wherein the conveyor supplies material rolls to five individual packing stations 61 through 65. Each of the packing stations is provided with a compact apparatus 1 of the invention supported above a work surface for creating and dispensing cushioning dunnage to the operator packing items and containers at the work station. One of the stations, 61, is shown schematically in side view in FIG. 16B. A taping machine is represented at 66.

The operation of the overhead roll-delivery system in FIGS. 14 and 15 will now be described. In a first step, paper rolls move (walk) on the dancing conveyor 52 until a roll-transfer gate 55 (closed) stops the roll from moving. When the roll stops moving, the roll-dispensing arm 56 pushes the roll out of tracks of the dancing conveyor. After the roll is pushed out of the dancing conveyor, the roll will stop against the roll-stop/release arm 70, shown in FIG. 15. As long as a roll stays against the roll-stop/release arm 70, the roll-transfer gate 55 stays open, allowing rolls of paper to move on the dancing conveyor to the next available station. When a new roll of paper is needed for a dispensing unit, e.g., one of the stations 61–65, for example, the operator uses the roll-stop/release arm 70 to release the stand-by roll so that the paper roll can fall into the auto-roll tensioning device 58 as shown in FIG. 15. At this point, the roll is ready to be used. After a roll falls into the auto-roll tensioning device, the roll-transfer gate 55 closes.

In the example embodiments, the paper material preferably has an initial width of 24 to 34 inches. After the edges are folded by the conversion assembly of the apparatus, the width of the pillow-shaped product is reduced to 7–8 inches, for example, with the continuous strip being perforated at 17 on each side every 7 inches, for example. The apparatus and dunnage product could, of course, be dimensioned for producing other sizes of cushioning product.

In use, the operator manually feeds the paper or other material from the supply roll 5 located in the vicinity of the compact apparatus 1 by pressing a feed switch 68 on controller 69, FIG. 1, until the paper extends from exit chute 21 at the front of the unit 1. The operator presses on a foot switch, not shown, to begin dispensing paper. As paper moves through the inside of the unit 1, the paper is folded and formed into pillow-like shapes for use as cushioning dunnage. The formed material is uniformly perforated on each side edge every 7 inches at 17 in the example embodiment. When a desired length of the cushioning product is reached, the operator releases the foot switch to stop dispensing cushioning product. The operator rips the cushioning product from the unit at a desired perforation line and places the product in the box 27 to use for void-fill or cushioning.

The compact apparatus and system of the invention is advantageously affordable and practical for customers whose packing needs can be met with a single unit that doesn't take up a lot of space. It also can also flexibly serve the needs of customers with high-speed and high-volume production lines where multiple, stand alone packing stations such as 61–65 and/or centralized packing stations are utilized. Raised flexible installation configuration options, which can be installed over or under work benches, and over or under conveyor lines, are shown in the several example embodiments. Multi-directional pivoting of the unit 1 on the stand/material cart is for ease of loading the paper material 8 in unit 1. Because perforation is achieved in the paper material on-site and in real-time, pre-perforated paper need not be provided on a roll.

While I have shown and described only several example embodiments in accordance with the present invention, it is understood that various changes and modifications can be made therein by the skilled artisan without departing from the invention. Therefore, I do not wish to be limited to specific example embodiments disclosed herein, but intend to cover such variations as are encompassed by the scope of the appended claims.

I claim:

1. A compact apparatus for creating and dispensing material for use as void fill and cushioning dunnage, said apparatus being capable of being mounted as a unit on a stand and comprising:

a motor and a material feeding arrangement driven by said motor, said material feeding arrangement comprising cooperating feed rollers for pulling material from a supply of material and feeding it through said apparatus;

a plurality of spaced input rollers which delimit an input opening upstream of said material feeding arrangement for shaping material to convert the material into a continuous strip of cushioning product as the material is fed through said apparatus; and a perforator driven by said motor for perforating material at spaced locations along the length of said material as the material is fed through said apparatus to allow an operator to rip from said apparatus a desired length of cushioning product being dispensed by said apparatus.

2. The apparatus according to claim 1, wherein said perforator comprises cooperating perforation gears between which said material is fed.

3. The compact apparatus according to claim 2, wherein said perforation gears are arranged coaxial with said feed rollers of said material feeding arrangement.

4. The apparatus according to claim 1, further comprising a material shaping member upstream of said input rollers which directs the lateral edges of the material in a first direction.

5. The apparatus according to claim 1, further comprising input and output chutes for guiding said material on respective sides of said material feeding arrangement.

6. The apparatus according to claim 1, wherein the size of the input opening delimited by the spaced input rollers is small enough to preclude an operator's hand from being inserted through the input opening for operator safety.

7. A compact apparatus for creating and dispensing material for use as void fill and cushioning dunnage, said apparatus being capable of being mounted as a unit on a stand and comprising:

a motor and a material feeding arrangement driven by said motor for pulling material from a supply of material and feeding it through said apparatus;

a plurality of material shaping members upstream of said material feeding arrangement for shaping material to convert the material into a continuous strip of cushioning product as the material is fed through said apparatus; and a perforator driven by said motor for perforating material at spaced locations along the length of said material as the material is fed through said apparatus to allow an operator to rip from said apparatus a desired length of cushioning product being dispensed by said apparatus, wherein said material shaping members include a first material shaping member which directs the lateral edges of the material in a first direction, and wherein said first material shaping member is a convex material shaping roller over which said material is drawn.

8. A compact apparatus for creating and dispensing material for use as void fill and cushioning dunnage, said apparatus being capable of being mounted as a unit on a stand and comprising:

a motor and a material feeding arrangement driven by said motor, for pulling material from a supply of material and feeding it through said apparatus;

a plurality of material shaping members upstream of said material feeding arrangement for shaping material to convert the material into a continuous strip of cushioning product as the material is fed through said apparatus; and a perforator driven by said motor for perforating material at spaced locations along the length of said material as the material is fed through said apparatus to allow an operator to rip from said apparatus a desired length of cushioning product being dispensed by said apparatus, wherein said material shaping members include a first material shaping member which directs the lateral edges of the material in a first direction, and wherein said material shaping members further comprise spaced input rollers which delimit an input opening through which said material is drawn for directing the lateral edges of the material in a second direction such that the edges are folded back on the material for forming a continuous strip of cushioning product.

9. The apparatus according to claim 8, wherein said spaced input rollers comprise a first pair of spaced, parallel rollers followed by a second pair of spaced, parallel rollers extending in a direction transverse to said first pair of rollers, said first and second pairs of rollers delimiting said input opening for shaping said material.

10. The apparatus according to claim 8, wherein the size of said input opening is small enough to preclude an operator's hand from being inserted through said input opening for operator safety.

11. A system for creating and dispensing material for use as void fill and cushioning dunnage, said system comprising:

a compact apparatus in the form of a pivotal head which is capable of being mounted as a unit on a stand, said compact, pivotal head including a motor and a material feeding arrangement driven by said motor, said material feeding arrangement comprising cooperating feed rollers for pulling material from a supply of material and feeding it through said apparatus;

a plurality of spaced input rollers which delimit an input opening upstream of said material feeding arrangement for shaping material to convert the material into a continuous strip of cushioning product as the material is fed through said apparatus; and a perforator driven by said motor for perforating material at spaced locations along the length of said material as the material is fed through said apparatus to allow an operator to rip from said apparatus a desired length of cushioning product being dispensed by said apparatus; and said system further comprising a stand on which said compact apparatus is mounted.

12. The system according to claim 11, wherein said compact apparatus is pivotally mounted on said stand to facilitate material loading.

13. The system according to claim 11, wherein said stand is in the form of a material cart with wheels, said material cart including a support for rotatably supporting a roll of material to be supplied to said compact apparatus.

14. The system according to claim 13, wherein said material cart includes a roll tensioner for tensioning the material being unwound from said roll by said compact apparatus.

15. The system according to claim 13, wherein said material cart includes a work surface for an operator handling cushioning product dispensed by said compact apparatus.

16. The system according to claim 11, wherein said stand includes a work surface for an operator handling cushioning product dispensed by said compact apparatus.

17. The system according to claim 11, further comprising a support for rotatably supporting a roll of material to be supplied to said compact apparatus.

18. The system according to claim 17, further comprising an overhead delivery system for delivering rolls of material to said roll support, said roll support being elevated above an adjacent work surface for an operator handling cushioning product dispensed by said compact apparatus.

19. The system according to claim 11, further comprising a conveyor located in front of said compact apparatus to provide a work surface for an operator handling cushioning product dispensed by said compact apparatus.

20. A system for creating and dispensing material for use as void fill and cushioning dunnage, said system comprising:

a compact apparatus in the form of a pivotal head capable of being mounted as a unit on a stand, said compact, pivotal head including a motor and a material feeding arrangement driven by said motor, said material feeding arrangement comprising cooperating feed rollers for pulling material from a supply of material and feeding the material through said apparatus;

a plurality of spaced input rollers which delimit an input opening upstream of said material feeding arrangement for shaping material to convert the material into a continuous strip of cushioning product as it is fed through said apparatus; and a perforator driven by said motor for perforating material at spaced locations along the length of said material as the material is fed through said apparatus to allow an operator to rip from said apparatus a desired length of cushioning product being dispensed by said apparatus; and said system further comprising a roll support for rotatably supporting a roll of material from which material to be supplied to said compact apparatus can be unwound.

21. The system according to claim 20, wherein said roll support includes a roll tensioner for tensioning the material being unwound from said roll by said compact apparatus.

22. The system according to claim 20, further comprising an overhead roll delivery system for delivering rolls of material to said roll support, said roll support being elevated above an adjacent work surface for an operator handling cushioning product dispensed by said compact apparatus.

* * * * *